US010822821B2

(12) United States Patent
Kelly

(10) Patent No.: US 10,822,821 B2
(45) Date of Patent: Nov. 3, 2020

(54) PORTABLE CONSTRUCTION TENT AND SYSTEM

(71) Applicant: Robert J. Kelly, Prairie View, IL (US)

(72) Inventor: Robert J. Kelly, Prairie View, IL (US)

( * ) Notice: Subject to any disclaimer, the term of this patent is extended or adjusted under 35 U.S.C. 154(b) by 189 days.

(21) Appl. No.: 16/108,979

(22) Filed: Aug. 22, 2018

(65) Prior Publication Data

US 2019/0063105 A1 Feb. 28, 2019

Related U.S. Application Data

(60) Provisional application No. 62/550,065, filed on Aug. 25, 2017.

(51) Int. Cl.

| | |
|---|---|
| ***E04G 21/28*** | (2006.01) |
| ***E04H 15/34*** | (2006.01) |
| ***E04H 15/02*** | (2006.01) |
| ***E04H 15/46*** | (2006.01) |
| *E04D 5/14* | (2006.01) |
| *E04H 15/58* | (2006.01) |

(52) U.S. Cl.

CPC ..... *E04G 21/28* (2013.01); *E04H 15/02* (2013.01); *E04H 15/34* (2013.01); *E04H 15/46* (2013.01); *E04D 5/14* (2013.01); *E04H 15/58* (2013.01)

(58) Field of Classification Search

CPC ..... E04H 15/02; E04H 15/34; E04H 15/44; E04H 15/46; E04H 15/58; E04H 15/18; E04G 21/28; E04G 2021/248; E04G 21/24

USPC ..... 135/900, 96; 52/3, DIG. 12

See application file for complete search history.

(56) References Cited

U.S. PATENT DOCUMENTS

| | | | | |
|---|---|---|---|---|
| 1,129,194 A * | 2/1915 | Hanley | E04H 15/46 135/140 |
| 4,084,598 A * | 4/1978 | Rainwater | E04H 15/44 135/121 |
| 5,215,108 A * | 6/1993 | Sprague | A47B 83/04 108/50.12 |
| 5,584,311 A * | 12/1996 | Schaefer | E04H 15/34 135/120.3 |
| 5,778,999 A * | 7/1998 | Nealeigh | E04G 21/28 182/129 |
| 7,264,012 B2 * | 9/2007 | Slade | E04G 21/28 135/900 |

(Continued)

FOREIGN PATENT DOCUMENTS

| | | | |
|---|---|---|---|
| EP | 0368393 A1 * | 5/1990 | E04G 21/28 |

*Primary Examiner* — David R Dunn
*Assistant Examiner* — Danielle Jackson
(74) *Attorney, Agent, or Firm* — Justin Lampel

(57) ABSTRACT

A portable construction tent is provided. The portable construction tent is especially suitable for use in inclement weather conditions. In particular, the portable construction tent is especially suitable for use on a building when construction or repair is being done to the roof of the building. The portable tent unfolds, is adjusted for size, and then is secured to the parapet walls of the roof and finally is locked into place. A discard-able, recycle-able wrap is draped over support poles of the tent and is secured. In an embodiment, the wrap may be a low-density polyethylene film or cellophane. Further, in an embodiment, the wrap may be heat shrunk around the poles (which may be steel rafters), which are bolted to the parapet walls. Once in place, the portable construction tent allows workers to work on the roof of a building in almost any weather condition.

14 Claims, 9 Drawing Sheets

(56) References Cited

U.S. PATENT DOCUMENTS

| | | | | |
|---|---|---|---|---|
| 9,181,723 | B2 * | 11/2015 | Schaefer | E04H 15/44 |
| 9,506,268 | B1 * | 11/2016 | Bright | E04H 15/02 |
| 9,797,154 | B1 * | 10/2017 | McKinney | E04G 21/28 |
| 2012/0067389 | A1 * | 3/2012 | Lin | E04H 15/16 135/121 |

* cited by examiner

PORTABLE CONSTRUCTION TENT AND SYSTEM

CROSS REFERENCE TO RELATED APPLICATIONS

The following application is a based on and claims the priority benefit of U.S. provisional application Ser. No. 62/550,065 filed Aug. 25, 2017; the entire content of which is incorporated by reference.

BACKGROUND OF THE INVENTION

A portable construction tent and system is provided. The portable construction tent is especially suitable for use in inclement weather conditions. In particular, the portable construction tent is especially suitable for use on a building when construction or repair is being done to the roof of the building. The portable tent unfolds, is adjusted for size, and then is secured to the parapet walls of the roof and finally is locked into place. A discard-able and recycle-able wrap is draped over support poles of the tent and is secured. In an embodiment, the wrap may be a low-density polyethylene film or cellophane. Further, in an embodiment, the wrap may be heat shrunk around the poles (which may be steel rafters), which are bolted to the parapet walls. Once in place, the portable construction tent allows workers to work on the roof of a building in almost any weather condition.

Portable tents have been made in the past. For example, U.S. Pat. No. 4,367,761 to Winant discloses a shelter having at least one roofing formed by a plurality of fabric panels which are assembled in their upper part along curvilinear edges. The edge of each panel forms two curves which converge at a center point and all the panels are united at this center point. The lower side of each panel is provided with two cables for exerting a tension thereon. These cables are spaced apart a distance which is less than the distance between the support posts supporting the outer ends of the seams between adjacent panels. A shelter having three panels thus covers a hexagonal area on the ground and a completely free space.

Further, U.S. Pat. No. 3,693,641 to Moss discloses a portable screen house which has a flexible frame structure and a cover supported in tension thereon. The cover has screen material for its sides and an impervious dome-shape top portion having an upwardly projecting cone-shape peak at its center. A bulbous ornament element is supported above the cone-shaped peak by the frame structure.

Still further, U.S. Pat. No. 8,453,664 to Parsons et al discloses a portable shelter which may be provided with ground assembly, flex poles, and a cover assembly. The ground assembly may include a ground sheet or pad having rigid elements, such as metal ground poles along opposite sides. The ground poles may extend through sleeves on the ground sheet. The ends of the flex poles can be attached to fittings on the ends of the ground poles, with the flex poles flexed into an arc when the shelter is set up. The cover assembly includes a flexible cover made for example of fabric effective at blocking sunlight. Flex pole attachment devices, such as snap-on clamp fittings, may be spaced apart along opposite ends of the cover for attaching the cover onto the flex poles. Ground pole attachment devices may be spaced apart along opposite sides of the cover for attaching the cover to the ground poles.

However, these portable construction tents fail to provide temporary protective tent for use on a roof which is easy to use, quick and inexpensive compared to other construction tents. In addition, the present portable construction tent is durable, withstanding high wind speeds.

SUMMARY OF THE INVENTION

A portable construction tent and system is provided. The portable construction tent is especially suitable for use in inclement weather conditions. In particular, the portable construction tent is especially suitable for use on a building when construction or repair is being done to the roof of the building. The portable tent unfolds, is adjusted for size, and then is secured to the parapet walls of the roof and finally is locked into place. A discard-able and recycle-able wrap is draped over support poles of the tent and is secured. In an embodiment, the wrap may be a low-density polyethylene film or cellophane. Further, in an embodiment, the wrap may be heat shrunk around the poles (which may be steel rafters), which are bolted to the parapet walls. Once in place, the portable construction tent allows workers to work on the roof of a building in almost any weather condition.

An advantage of the present device is that the present portable construction tent may allow construction or repair of a roof in inclement weather.

An advantage of the present device is that the present portable construction tent may provide shade and shelter to workers who are working on the roof of a building.

Another advantage of the present device is that the present portable construction tent is easy to use and efficient.

And yet another advantage of the present device is that the present device may prevent delays in construction due to weather by protecting both the workers and the worksite and therein allowing more efficient scheduling.

Still another advantage of the present device is that the present portable construction tent is ideal for temporarily securing to a parapet roof.

Yet another advantage of the present device is that the present portable construction tent may have support beams, rafters and other steel fasteners which may be re-used and a discard-able and recycle-able low-density polyethylene film (which may be cellophane) wrap.

Another advantage of the present device is that the present device may have a waterproof protective cover.

Still another advantage of the present device is that the present device may withstand high wind speeds, hail and sleet.

Yet another advantage of the present device is that the present device may be durable so as to be able to withstand snow accumulation, which may occur on the cover.

For a more complete understanding of the above listed features and advantages of the present portable construction tent reference should be made to the following detailed description of the preferred embodiments. Further, additional features and advantages of the invention are described in, and will be apparent from, the detailed description of the preferred embodiments.

DETAILED DESCRIPTION OF THE PREFERRED EMBODIMENTS

A portable construction tent and system is provided. The portable construction tent is especially suitable for use in inclement weather conditions. In particular, the portable construction tent is especially suitable for use on a building when construction or repair is being done to the roof of the building. The portable tent unfolds, is adjusted for size, and then is secured to the parapet walls of the roof and finally is locked into place. A discard-able, recycle-able wrap is draped over support poles of the tent and is secured. In an embodiment, the wrap may be a low-density polyethylene film or cellophane. Further, in an embodiment, the wrap may be heat shrunk around the poles (which may be steel rafters), which are bolted to the parapet walls. Once in place, the portable construction tent allows workers to work on the roof of a building in almost any weather condition.

Figure 1:
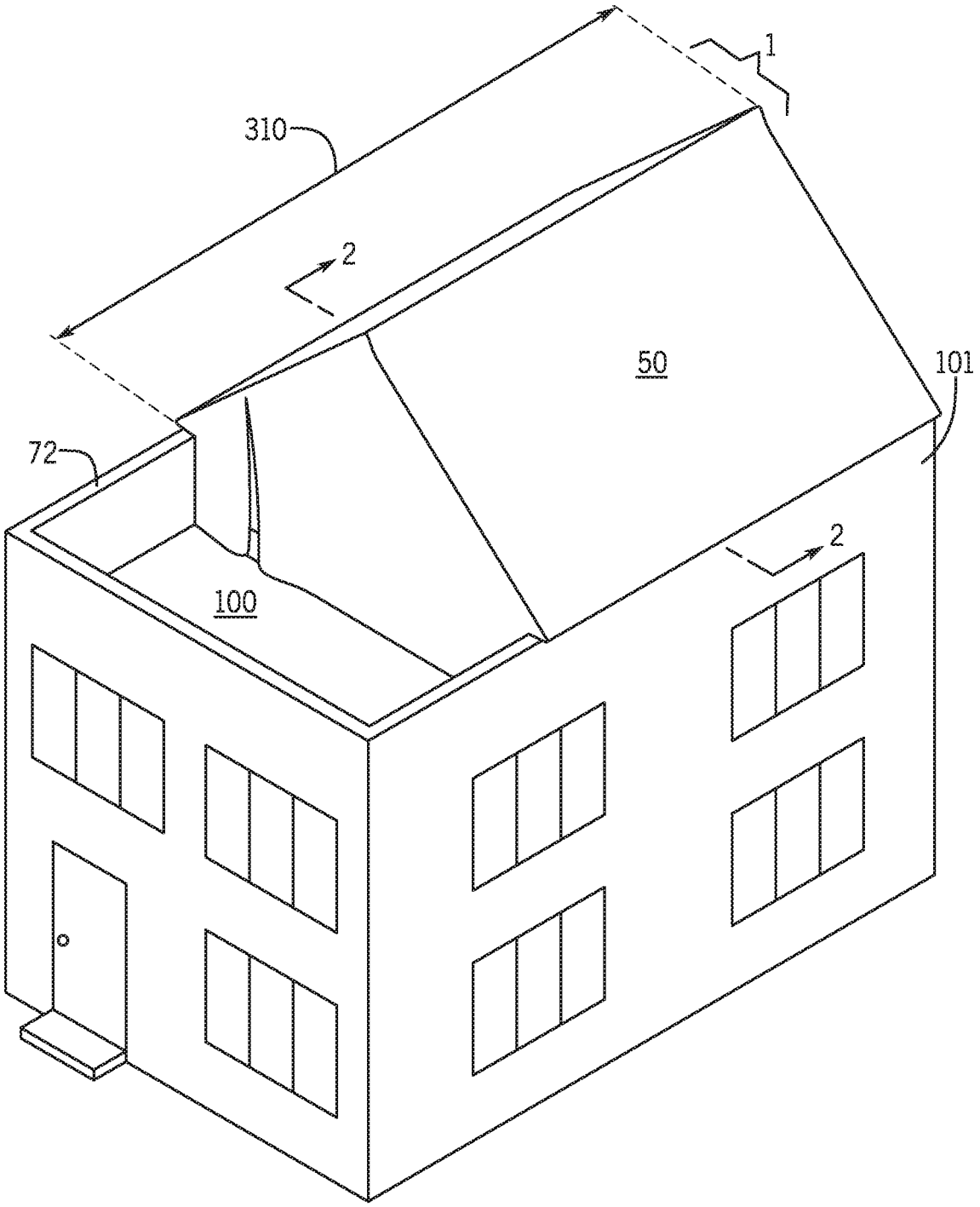
FIG. 1 illustrates a perspective view of the portable construction tent wherein the tent is secured to the parapet walls of a roof of a building.
Figure 2:
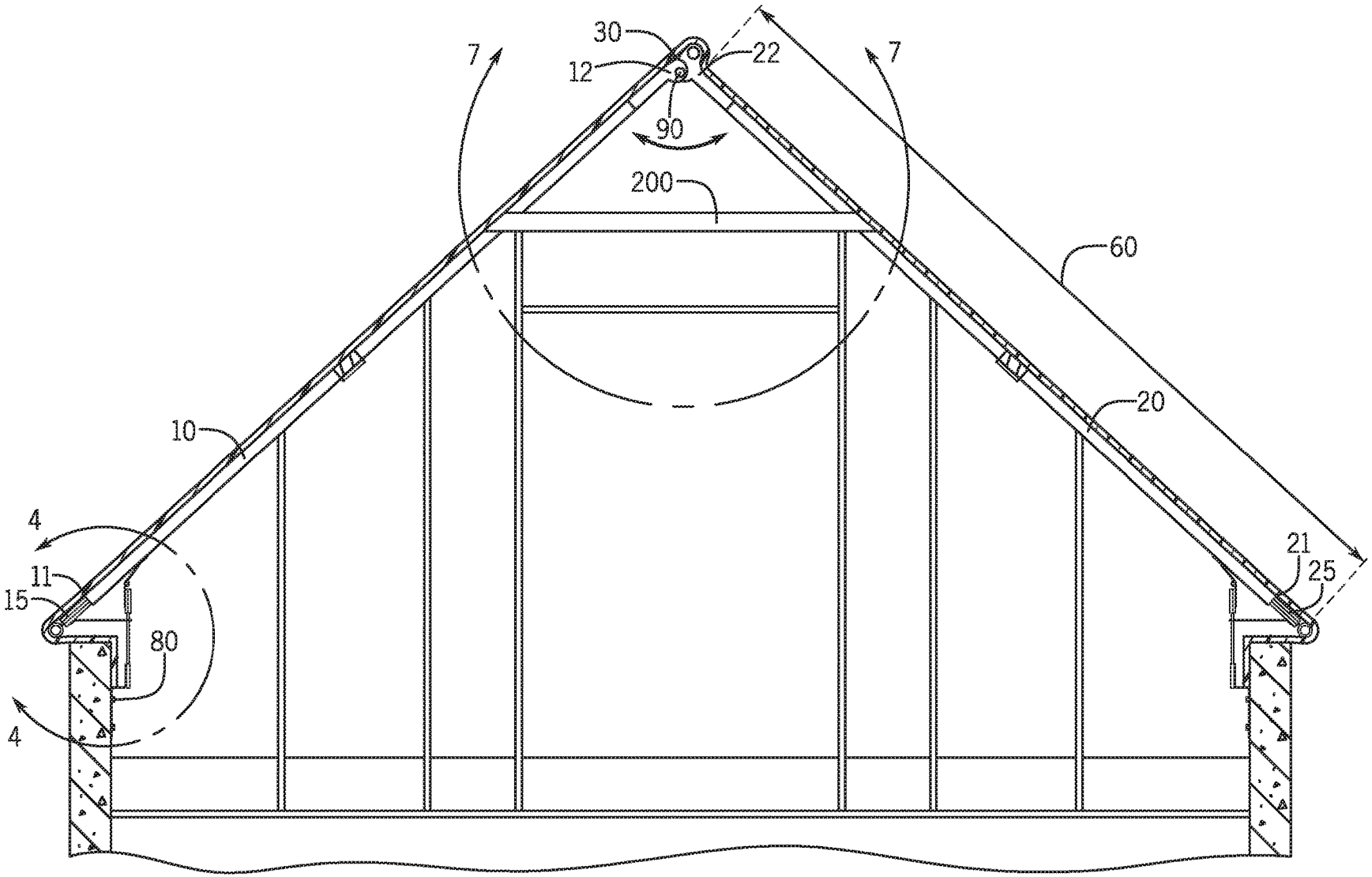
FIG. 2 illustrates a cross sectional view of the portable construction tent secured to the parapet walls of a roof of a building.

Referring first to FIGS. 1 and 2, in an embodiment, a portable construction tent 1 is provided for use on a roof 100 of a building 101. The portable construction tent 1 may have a plurality of units including a plurality of first unit poles 10, 20 (or 'rafters"), a plurality of pivot point units 30, a plurality of first and second parapet braces 40 (or "bracket") (FIG. 4) and a flexible or bendable cover 50. Ideally, the cover 50 is a durable low-density polyethylene film or cellophane cover which may be discarded and/or recycled after each use. Further, in an embodiment, the cover 50 may be heat shrunk around at least the first unit poles 10, 20 of the device 1 to produce a tight and secure tent.

Figure 4:
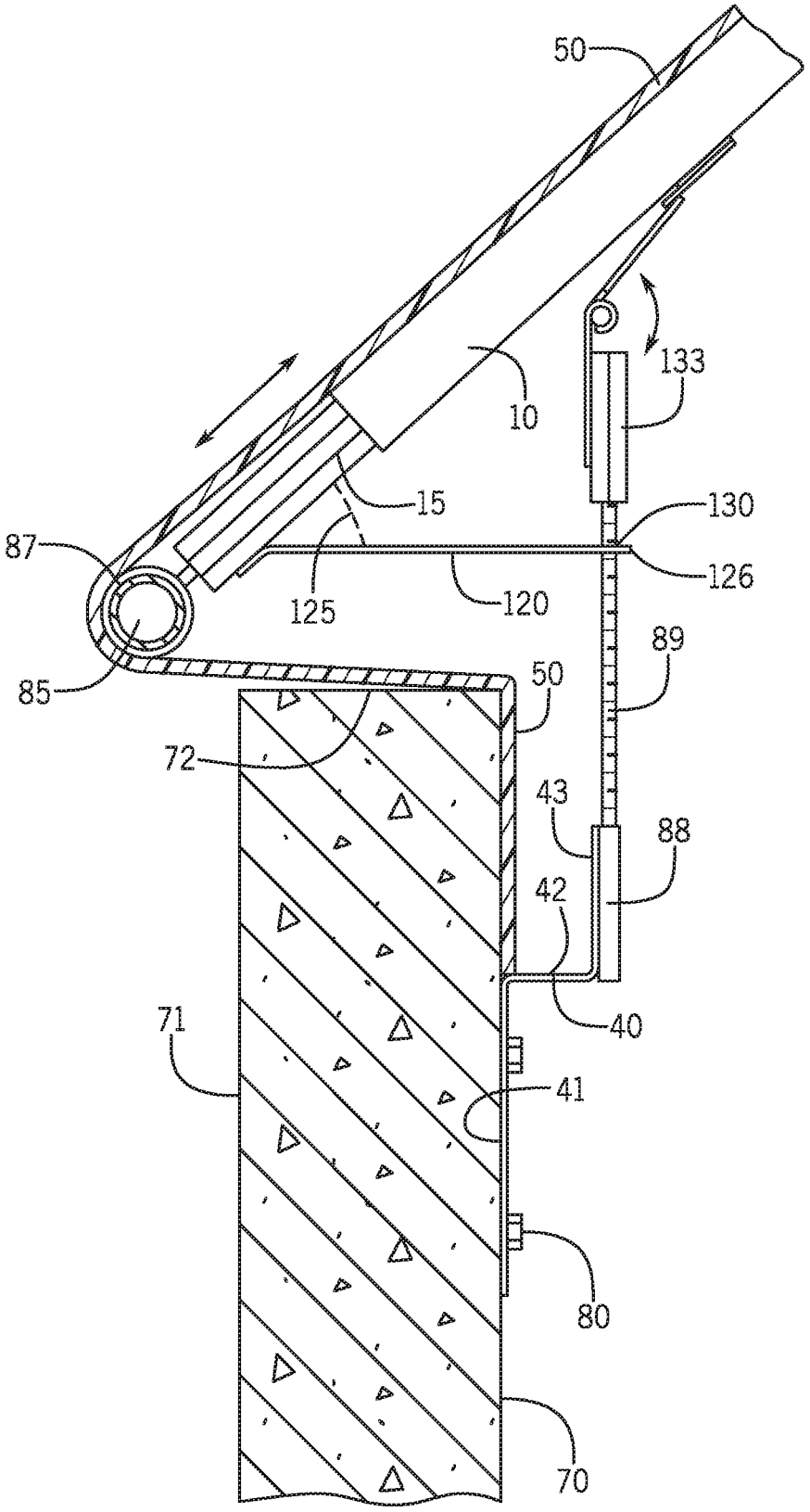
FIG. 4 illustrates a close-up cross-sectional view of the portable construction tent secured to a parapet wall of a roof in one embodiment.
Figure 5A:
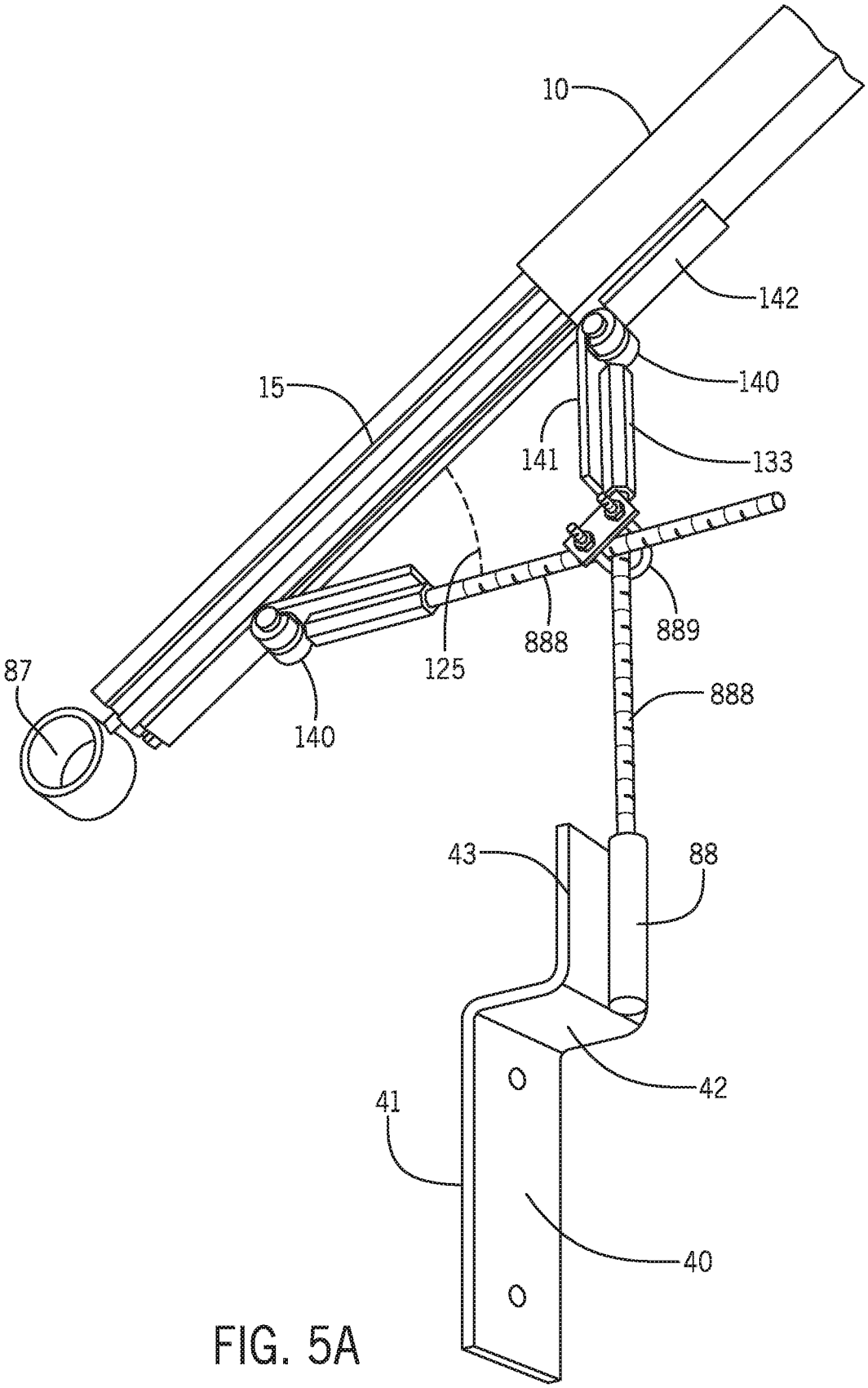
FIG. 5A illustrates a perspective view of the securing brace and two hinges of the device of the portable construction tent in the preferred embodiment.
Figure 5B:
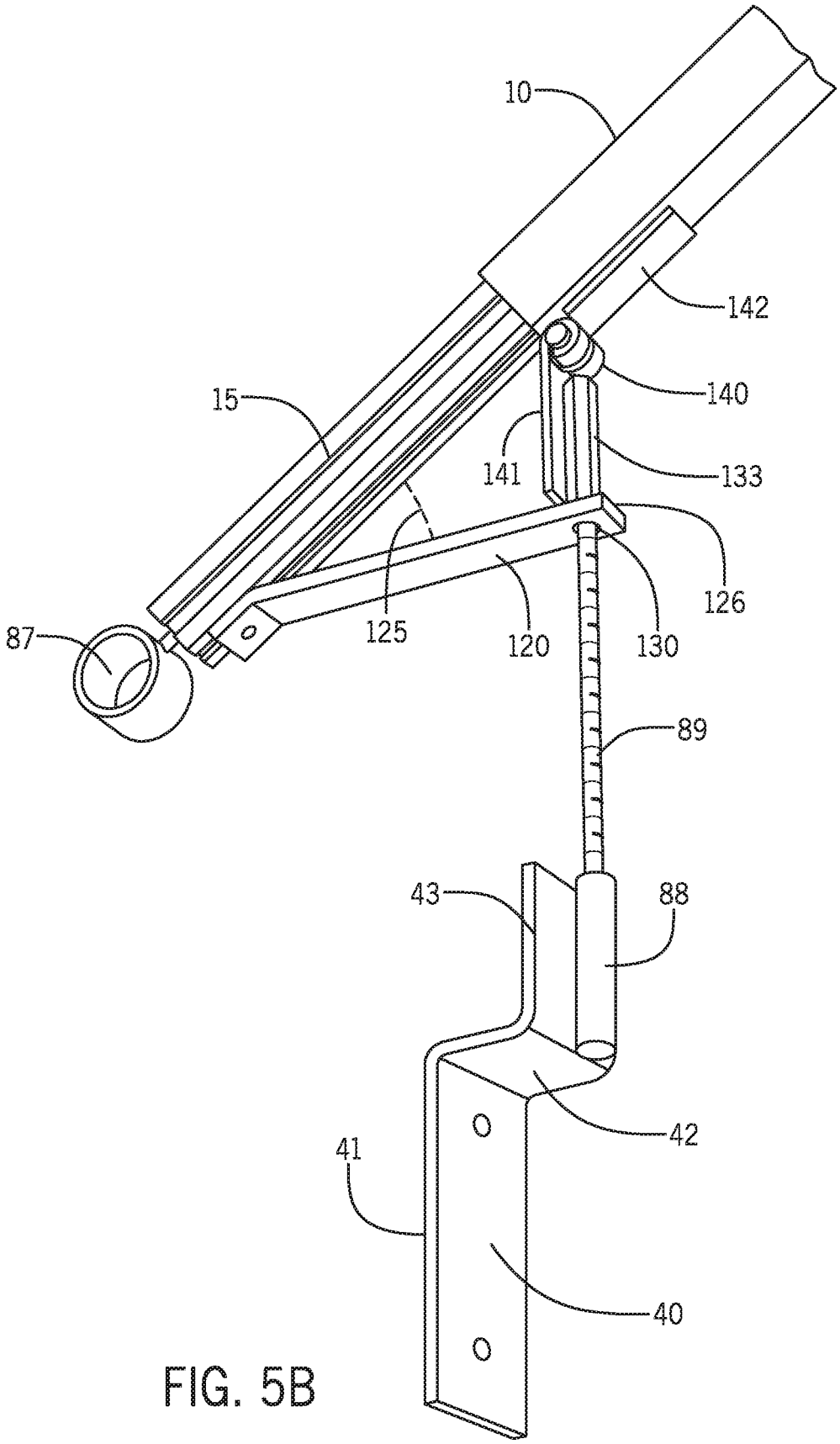
FIG. 5B illustrates an alternative embodiment wherein one hinge is used instead of two hinges.
Figure 6:
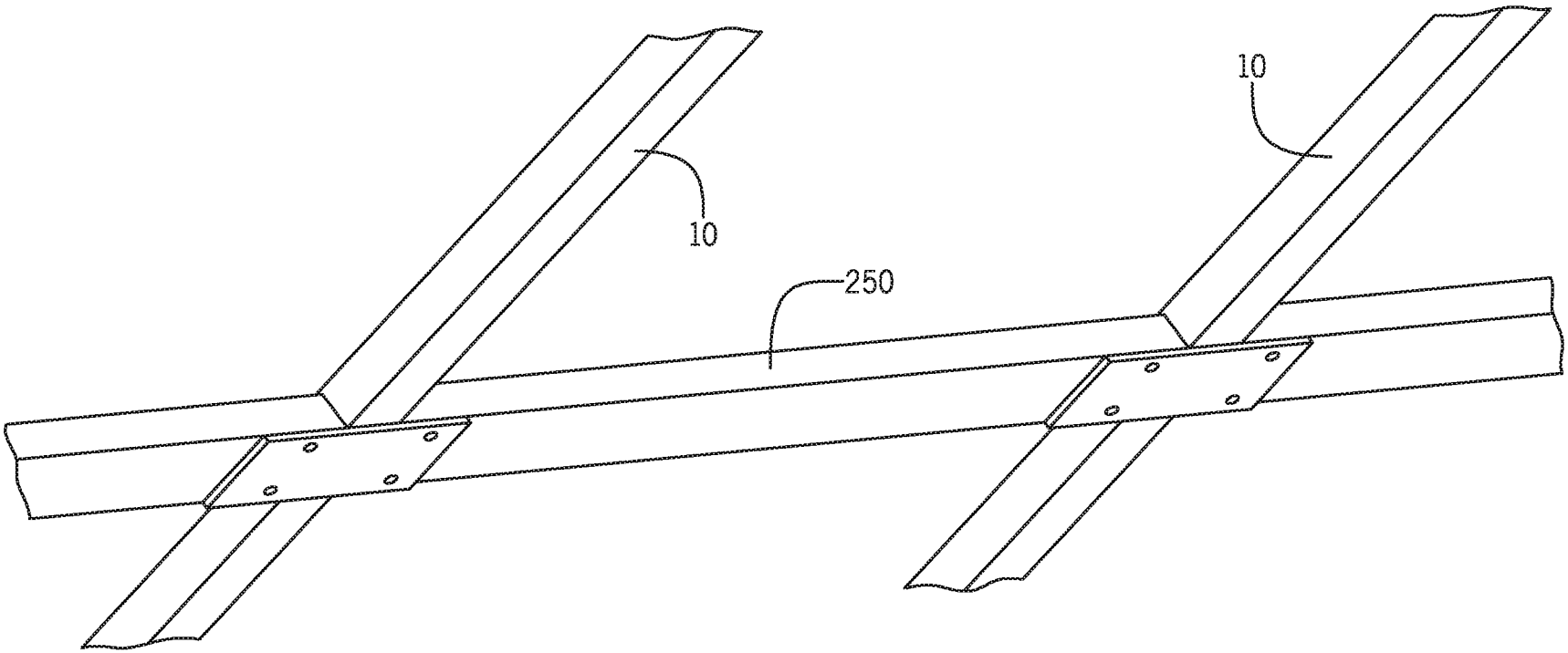
FIG. 6 illustrates a perspective view of a cross beam and two first unit poles of the portable construction tent.

Referring now to FIGS. 4 and 5A-5B, the parapet brace 40 may have a generally flat first section (or first 'unit') 41, which may be secured to the inside-facing side 70 of a parapet wall 71. The generally flat first section 41 may be secured to the inside-facing side 70 of the parapet wall 71 by, for example, screws, bolts, nails or the like 80. The generally flat first section 41 may, in an embodiment, have a perpendicular extension 42. The perpendicular extension 42 may secure a second generally flat third section 43 (which may be parallel to the first generally flat section 41). The perpendicular extension 42 may allow the brace 40 to be utilized with, for example, an extended top 72 of the parapet wall 71. The generally flat third section 43 may have, for example, a cylindrical tube 88 which temporarily receives a support pole (888 in FIG. 5A or 89 in the FIGS. 4 and 5B embodiment). In use, a plurality of braces 40 are utilized running all along the entire inside 70 of the parapet wall 71. More specifically, if the tent 1, as shown in FIG. 1, uses ten first unit poles 10, 20 then ten braces 40 would be utilized. Further, braces 40 used on one side of the parapet wall 71 of the roof 100 are applied in a mirror image orientation as the braces 40 utilized on the other side of the roof 100. In an embodiment, the support poles 888, 89 may be solid so as to increase the durability of the support poles 888, 89. Preferably the support poles 888, 89 are made of metal.

The first unit pole 10 may have a first end 11 and a second end 12 and an opposing first unit pole 20 may also have a first end 21 and a second end 22. The second ends 12, 22 of the two first unit poles 10, 20 may meet at the pivot point unit 30; which allows opposing first unit poles 10, 20 to pivot with respect to each other, therein allowing for the distance between the first ends 11, 21 of the poles 10, 20 to be adjusted depending on the width of the roof 100. The pivot point units 30 may be generally flat portions of the first unit poles 10, 20 having openings 90 (as described below).

The first unit poles 10, 20 may have an interior pole 15, 25 which may telescopingly extend partly within the interior of first unit poles 10, 20 (as shown in FIG. 4). The interior poles 15, 25 of the first unit poles 10, 20 may allow the overall lengths 60 (FIG. 2) of the device 1 to be adjusted; depending on the size of the roof 100. The interior poles 15, 25 thus have a diameter which is less than the diameter of the interior of the first unit poles 10, 20 so that the interior poles 15, 25 may telescopically be inserted into the first unit poles 10, 20.

Figure 3:
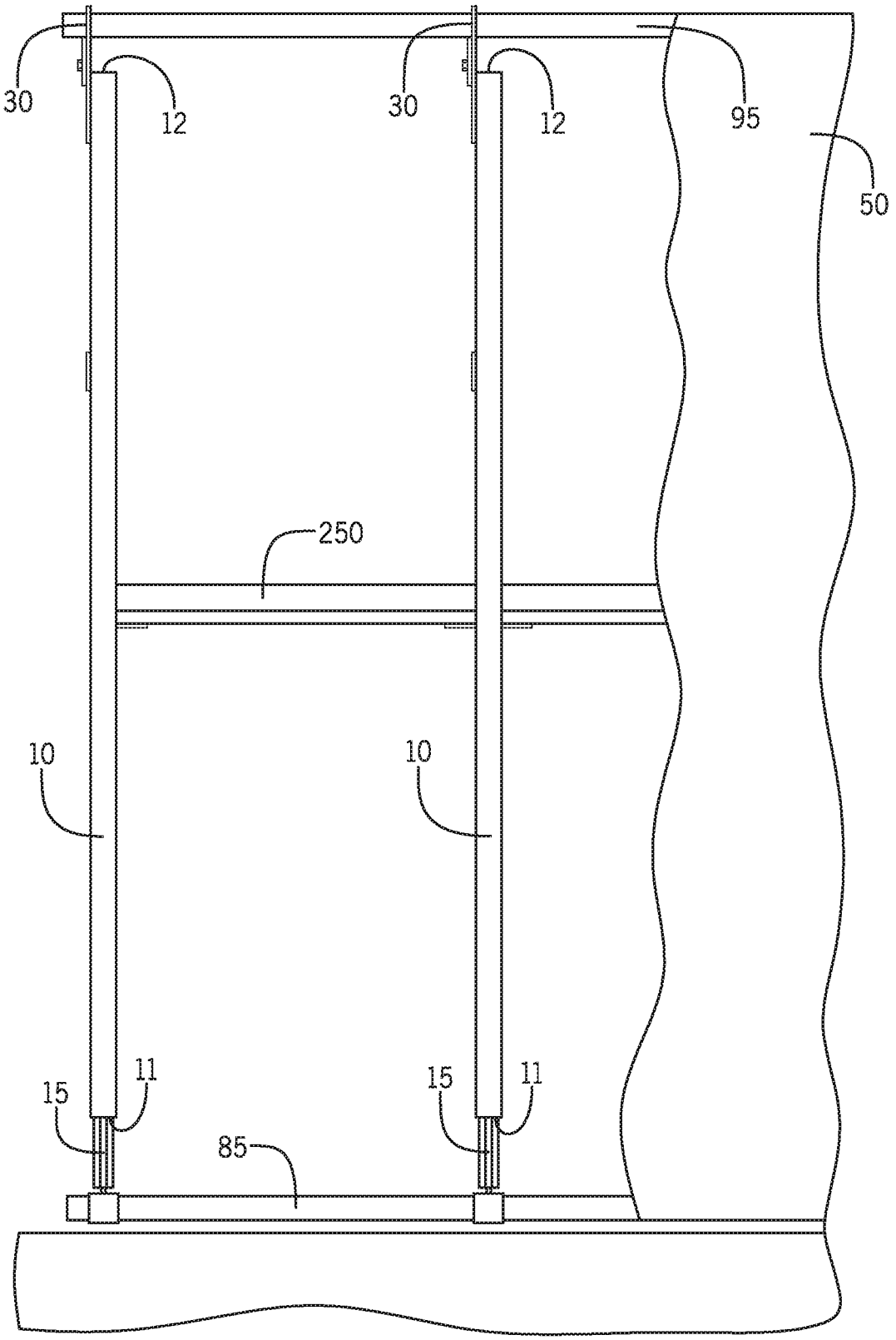
FIG. 3 illustrates a plan view of the exterior side of one of the sides of the portable construction tent.

Further, the interior poles 15, 25 of the first unit poles 10, 20 may be connected to an elongated pole ring 87 which receives an elongated pole 85 (FIGS. 3 and 4) wherein the elongated pole 85 may extend along a length of the top of the parapet wall 71 being worked on. During use, the first unit poles 10, 20, interior poles 15, 25 and braces 40 are all secured into place before the cover 50 is secured to the device 1.

Referring again to FIG. 5A, in a first embodiment, both the interior poles 15, 25 as well as the first unit poles 10, 20 each have a (first) hinge 140 having a first unit 141 and a second unit 142. In the FIG. 5A embodiment, the second unit 142 of the (first) hinge 140 is secured to the first unit poles 10, 20 wherein the first unit 141 of the (first) hinge 140 is not secured to the first unit poles 10, 20 and wherein the first unit 141 of the (first) hinge 140 may rotate with respect to the second unit 142 of the (first) hinge 140. Further, the second unit 142 of a (second) hinge 140 may be secured to the interior poles 15, 25 in a mirror orientation so that the second unit 142 of the (second) hinge 140 does not move with respect to the interior poles 15, 25 but the first unit 141 of the (second) hinge 140 may rotate with respect to the interior poles 15, 25.

The first units 141 of the first and second hinges 140 may each have a securing device 133 for temporarily receiving a support pole 888. The angles 125 of all of the hinges 140 may be adjusted therein allowing the device 1 to properly fit on a wide range of roofs. During installation of the device 1, once the first unit poles 10, 20 and interior poles 15, 25 are in the proper place and the proper angles 125 are adjusted, a clamp 889 may secure the two support poles 888 together as shown in FIG. 5A. This prevents movement or shifting of the first unit poles 10, 20 and interior poles 15, 25 during use of the device 1.

Referring again to FIGS. 4 and 5B, in an alternative embodiment, the interior poles 15, 25 may have an extended platform 120 (as opposed to a second hinge 140 as shown in FIG. 5A). The extended platform 120 may extend from the interior pole 15, 25 at an angle 125 so that the extended platform 120 remains generally parallel to the roof 100 of the building 101 when in use. Further, in one embodiment, the extended platform 120 may be slightly bendable so as to allow a user to more easily alter the angle 125 to allow the extended platform 120 to rest substantially parallel to the top of the roof 100 when in use. In a second embodiment, the extended platform 120 is rigid. An opening 130 may be located near a distal end 126 of the extended platform 120 wherein the opening 130 receives the support pole 89.

The top end of the support pole 89 may be received by a securing device 133 wherein the securing device 133 may be located above the extended platform 120. The securing device 133 may be, for example in one embodiment, a threaded member which receives the threaded member portion of the top of the support pole 89. The securing device 133 may thus secure the support pole 89 to the extended platform 120.

As stated above similar to the embodiment of FIG. 5A, in an embodiment, a hinge 140 having a first unit 141 and a second unit 142 may be utilized with the support pole 89. In particular, the securing device 133 for the support pole 89 may be attached to the first unit 141 of the hinge 140 while the second unit 142 of the hinge 140 is attached to the first unit pole 10, 20. The hinge 140 may thus allow a user to alter the angle 125 between the extended platform 120 and the first pole 10.

Located at the pivot point unit 30 may be an opening 90 wherein an elongated pole 95 (FIG. 3) extends through the center of the opening 90 of the pivot point unit 30. The pivot point unit 30 may therein allow opposing the first unit poles 10, 20 to rotate or be adjusted distance-wise with respect to one another; depending on the size of the roof 100.

Figure 7:
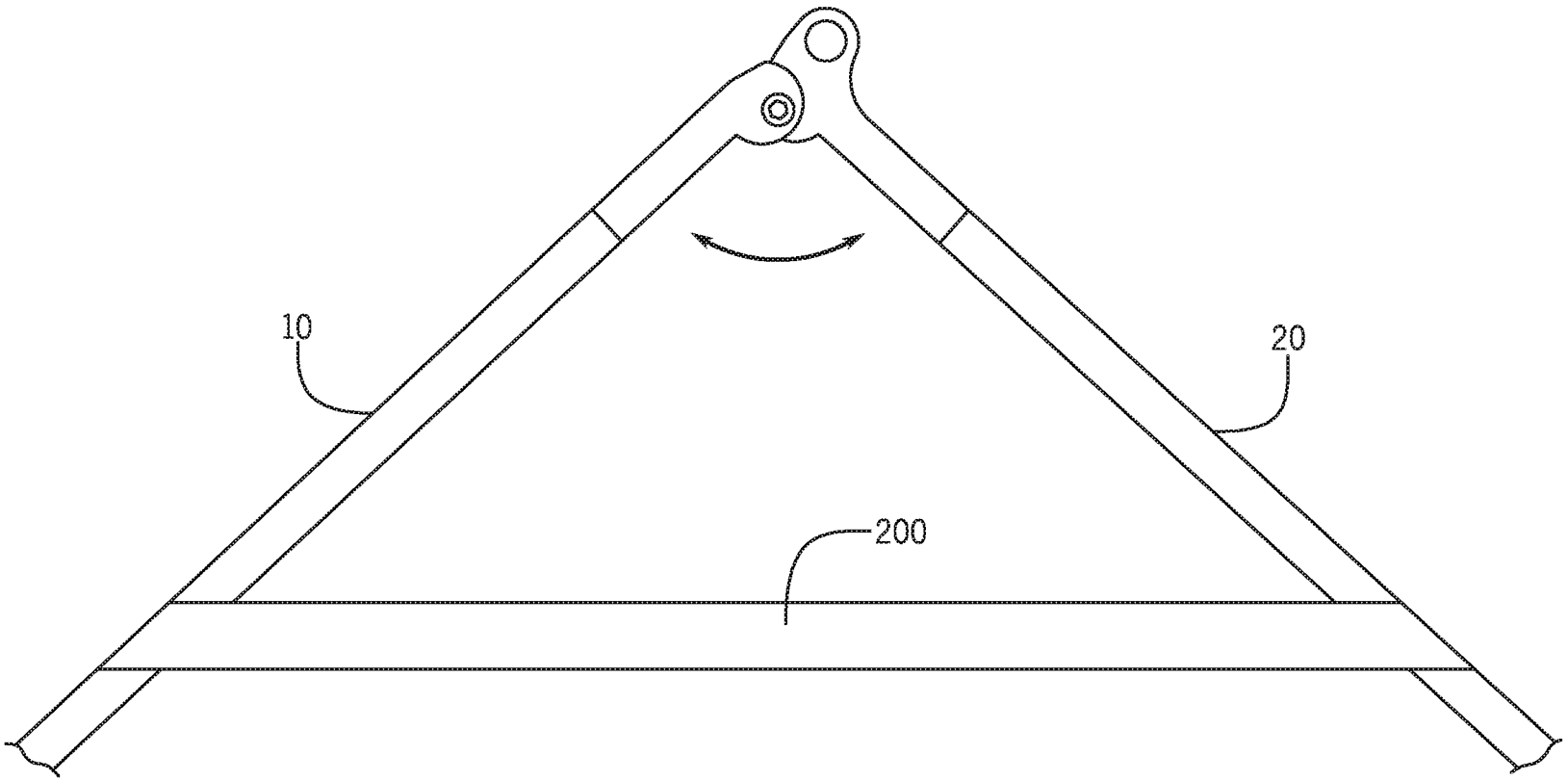
FIG. 7 illustrates a plan view of the support beams of the portable construction tent connecting two first unit poles.
Figure 8:
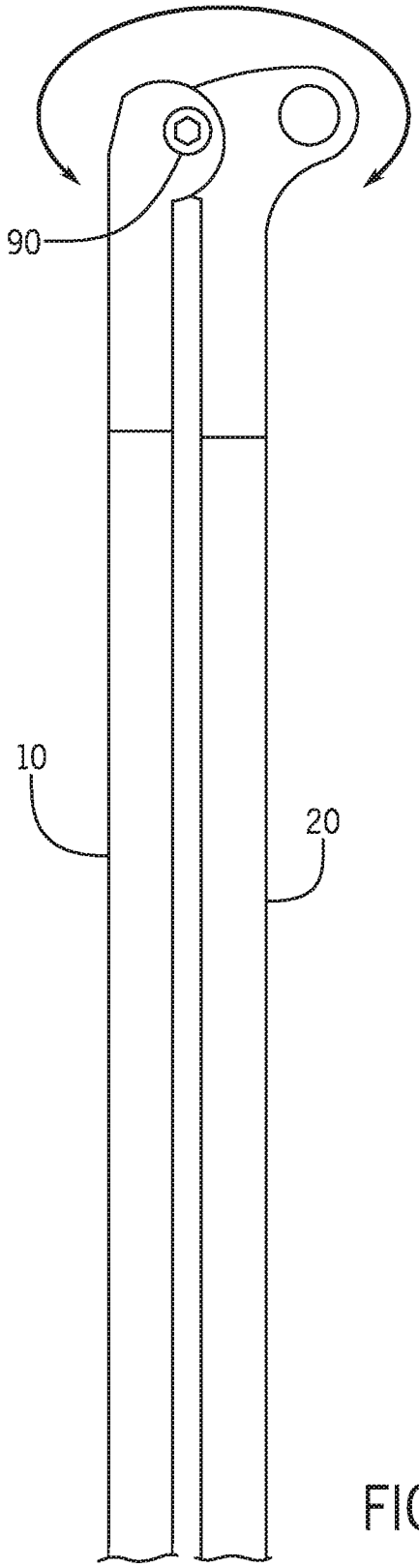
FIG. 8 illustrates a view of the first unit pole and of a second first unit pole in the folded position prior to use as is shown in FIG. 7.

In an embodiment, a cross beam 200 (FIG. 7) may be attached to opposing the first unit poles, 10, 20 (after the opposing first unit poles 10, 20 are in place) so as to provide better overall support to the tent 1 during use and to prevent shifting or collapse of the tent 1. Further, in an embodiment, a second cross beam 250 (or "support beam") may be perpendicularly secured to the first unit poles 10, 20 so as to provide additional structural support during use. In an embodiment, the cross beam 250 may be a standard 2×4.

To secure the cover 50 to the device 1, in one embodiment, the cover 50 may be first secured to the inside surface 70 of the parapet wall 71 by, for example, securing an end of the cover 50 between the generally flat first section 41 of the parapet brace 40 and securing the same by the securing devices 80.

The cover 50 may then pass over the top of the parapet wall 71 and then wrap around the elongated pole 85 which also extends substantially the entire length 310 (FIG. 1) of the tent 1. After the cover 50 extends around the elongated pole 85 the cover 50 travels up toward the pivot point unit 30 and then over the pivot point unit 30 and down the other side of the tent 1 where it is secured in a mirror-image fashion. It should be noted that multiple sheets of the cover 50 may be used in an overlapped manner. Once in place, the cover 50 may be tightly secured to the frame (for example, first unit poles 10, 20) by being heat shrunk by, for example, fire or hot air. Once tight, the cover 50 provides optimal protection to the workers and jobsite.

The figures generally illustrate the elongated pole 85 which receives the cover 50 located outside the width of the parapet wall 71; however, it should be understood that the elongated pole 85 may be located directly above the parapet wall 71 depending on the desired application for a project.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

The invention claimed is:

1. A tent for a roof comprising:

a first unit pole having a first end, a second end and a generally hollow interior;

an interior pole which telescopingly extends partially within the interior of the first unit pole;

a second first unit pole in mirror orientation with the first unit pole wherein the first unit pole and the second first unit pole meet at a pivot point unit and pivot with respect to each other;

a brace capable of being secured to a roof;

a first support pole having a first end and a second end wherein the first support pole is attached to the brace at the first end of the first support pole and temporarily secured to the first unit pole at the second end of the first support pole; and a hinge having a first unit, a second unit and a pivot point wherein the first unit of the hinge is permanently secured to the first unit pole and wherein the second unit of the hinge pivots at the pivot point and wherein the second unit of the hinge has a securing device for temporarily receiving and securing the second end of the first support pole.

2. The tent for a roof of claim 1 further comprising:

a second hinge wherein the second hinge has a first unit, a second unit and a pivot point wherein the first unit of the second hinge is secured to the interior pole and wherein the second unit of the second hinge pivots at the pivot point with respect to the first unit of the second hinge and wherein the second unit of the second hinge has a securing device for temporarily receiving and securing a second support pole.

3. The tent for a roof of claim 2 further comprising:

a clamp for securing the first support pole to the second support pole.

4. The tent for a roof of claim 1 further comprising:

an elongated pole ring located at a first end of the interior pole wherein the securing loop secures an elongated pole.

5. The tent for a roof of claim 1 further comprising:

a cover secured over the first unit pole and the second first unit pole.

6. The tent for a roof of claim 5 wherein the cover is cellophane or polyethylene film.

7. The tent for a roof of claim 1 further comprising:

a first section of the brace, a second section of the brace and a perpendicular extension separating the first section of the brace from the second section of the brace wherein the first section of the brace and the second section of the brace are parallel to each other and wherein the first section of the brace and the second section of the brace are both perpendicular to the perpendicular extension.

8. The tent for a roof of claim 7 further comprising:

an opening on the first section of the brace for receiving a securing device to secure the brace to a parapet wall of a roof of a building.

9. A system for securing a tent to a roof comprising:

a first unit pole having a first end, a second end and a generally hollow interior;

an interior pole which telescopingly extends partially within the interior of the first unit pole;

a second first unit pole in mirror orientation with the first unit pole wherein the first unit pole and the second first unit pole meet at a pivot point unit and pivot with respect to each other;

a brace capable of being secured to a roof;

a first support pole having a first end and a second end wherein the first support pole is attached to the brace at the first end of the first support pole and temporarily secured to the first unit pole at the second end of the first support pole;

wherein the angle of the first unit pole with respect to the second first unit pole is capable of being adjusted;

a cover secured over the first unit pole and the second first unit pole; and a hinge having a first unit, a second unit and a pivot point wherein the first unit of the hinge is permanently secured to the first unit pole and wherein the second unit of the hinge pivots at the pivot point and wherein the second unit of the hinge has a securing device for temporarily receiving and securing the second end of the first support pole.

10. The system for securing a tent to a roof of claim 9 wherein the cover is heat shrunk over the first unit pole and the second first unit pole.

11. A tent for a roof comprising:

a first unit pole having a first end, a second end and a generally hollow interior;

an interior pole which telescopingly extends partially within the interior of the first unit pole;

a second first unit pole in mirror orientation with the first unit pole wherein the first unit pole and the second first unit pole meet at a pivot point unit and pivot with respect to each other;

a brace capable of being secured to a roof;

a first support pole having a first end and a second end wherein the first support pole is attached to the brace at the first end of the first support pole and temporarily secured to the first unit pole at the second end of the first support pole; and an extended platform extending from the interior pole at an angle wherein the extended platform has an opening for receiving the first support pole.

12. The tent for a roof of claim 11 wherein the support pole is threaded.

13. The tent for a roof of claim 11 further comprising:

a cover secured over the first unit pole and second first unit pole.

14. The tent for a roof of claim 13 wherein the cover is heat shrunk over the first unit pole and the second first unit pole.

* * * * *